United States Patent [19]

Poisson

[11] 4,433,493

[45] Feb. 28, 1984

[54] HIGH TEMPERATURE RESISTANT FABRICS

[75] Inventor: William H. Poisson, Lincoln, Mass.

[73] Assignee: Albany International Corp., Albany, N.Y.

[21] Appl. No.: 459,417

[22] Filed: Jan. 20, 1983

[51] Int. Cl.[3] ..... B32B 5/08

[52] U.S. Cl. ..... 34/116; 34/123; 66/195; 66/202; 428/229; 428/253; 428/254; 428/258; 428/259; 428/902; 428/920

[58] Field of Search ..... 34/116, 123; 66/195, 66/202; 428/229, 253, 254, 258, 902, 920, 259

[56] References Cited

U.S. PATENT DOCUMENTS

| | | | |
|---|---|---|---|
| 3,871,946 | 3/1975 | Romanski et al. | 428/259 |
| 4,015,038 | 3/1977 | Romanski et al. | 428/259 |
| 4,394,413 | 7/1983 | Westhead | 428/920 |

*Primary Examiner*—James C. Cannon

*Attorney, Agent, or Firm*—Kane, Dalsimer, Kane, Sullivan & Kurucz

[57] ABSTRACT

The disclosure is of an improved high temperature resistant open mesh fabric and its use in a method for drying textiles.

5 Claims, 6 Drawing Figures

BAR1 0-2/2-0
BAR2 0-2/2-0/2-4/4-2/2-4/4-2/2-4/2-0/0-2/2-0
BAR3 2-2/0-0

HIGH TEMPERATURE RESISTANT FABRICS

BACKGROUND OF THE INVENTION

1. Field of the Invention

The invention relates to improved high temperature-resistant fabrics and their use as conveyors in the drying of textile fabrics.

2. Brief Description of the Prior Art

The drying of textile fabrics by passing them through drying ovens while they are supported on air-permeable conveyor belts is well known and is an accepted practice in the textile industry. The conveyor belts employed to carry the moist textiles through the drying ovens are an important part of the drying process, since the heated drying air being circulated through the textile must also pass through the conveyor belting for efficient drying. Representative of conveyor beltings used in the prior art to carry textiles through drying ovens are those described in U.S. Pat. Nos. 3,871,946 and 4,015,038.

The improved method of the present invention employs conveyor belting fabric of a specific character. The use of this specific belting fabric enhances the efficiency of drying. The specific belting employed also exhibits structural stability superior to heretofore used belting, even under high temperature conditions. This structural stability reduces frequency of shutdowns of the conveyors, enhancing overall efficiency of the drying process.

SUMMARY OF THE INVENTION

The invention comprises a fabric, which comprises;

(a) at least three warpwise elements in each of an array of parallel warp knitted chains extending in the machine-direction, said chains being evenly spaced from each other at intervals of from 2 to 12 per inch of fabric, said elements comprising (i) a first chain stitch yarn;

(ii) a second chain stitch yarn with periodic underlaps connecting adjacent chains;

(iii) a first reinforcing lay-in yarn having a linear density of from about 400 to about 5000 denier; and optionally (iv) a second reinforcing lay-in yarn having said linear density;

provided that when the yarn (iv) is not present then the linear density of yarn (iii) is doubled; and (b) a plurality of cross-machine direction yarns evenly spaced from each other in intervals of from 2 to 12 per inch of fabric and positioned between the warpwise elements (i), (ii) and (iii).

The invention also comprises endless belts fabricated from the fabric of the invention and their use in conveying a textile fabric through a drying oven.

DETAILED DESCRIPTION OF THE PREFERRED EMBODIMENTS OF THE INVENTION

Figure 1:
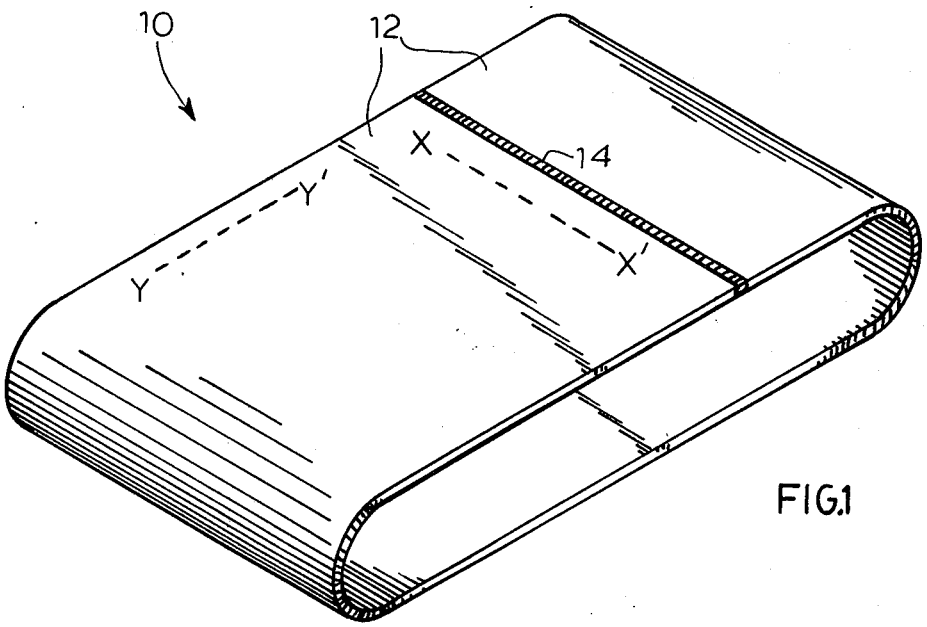
FIG. 1 is an endless conveyor belt used in the method of the invention. The machine direction is indicated by the symbols Y . . . Y'; the cross-machine direction by X . . . X'.

FIG. 1 shows an endless conveyor belt 10 which may be used in the improved method of the invention. Belt 10 may be made endless from a flat, open-mesh, knitted fabric 12 by joining the ends of the fabric 12 through conventional seaming procedures. The seam 14 may be, for example, formed by the use of a conventional fold back pin seam.

Figure 2:
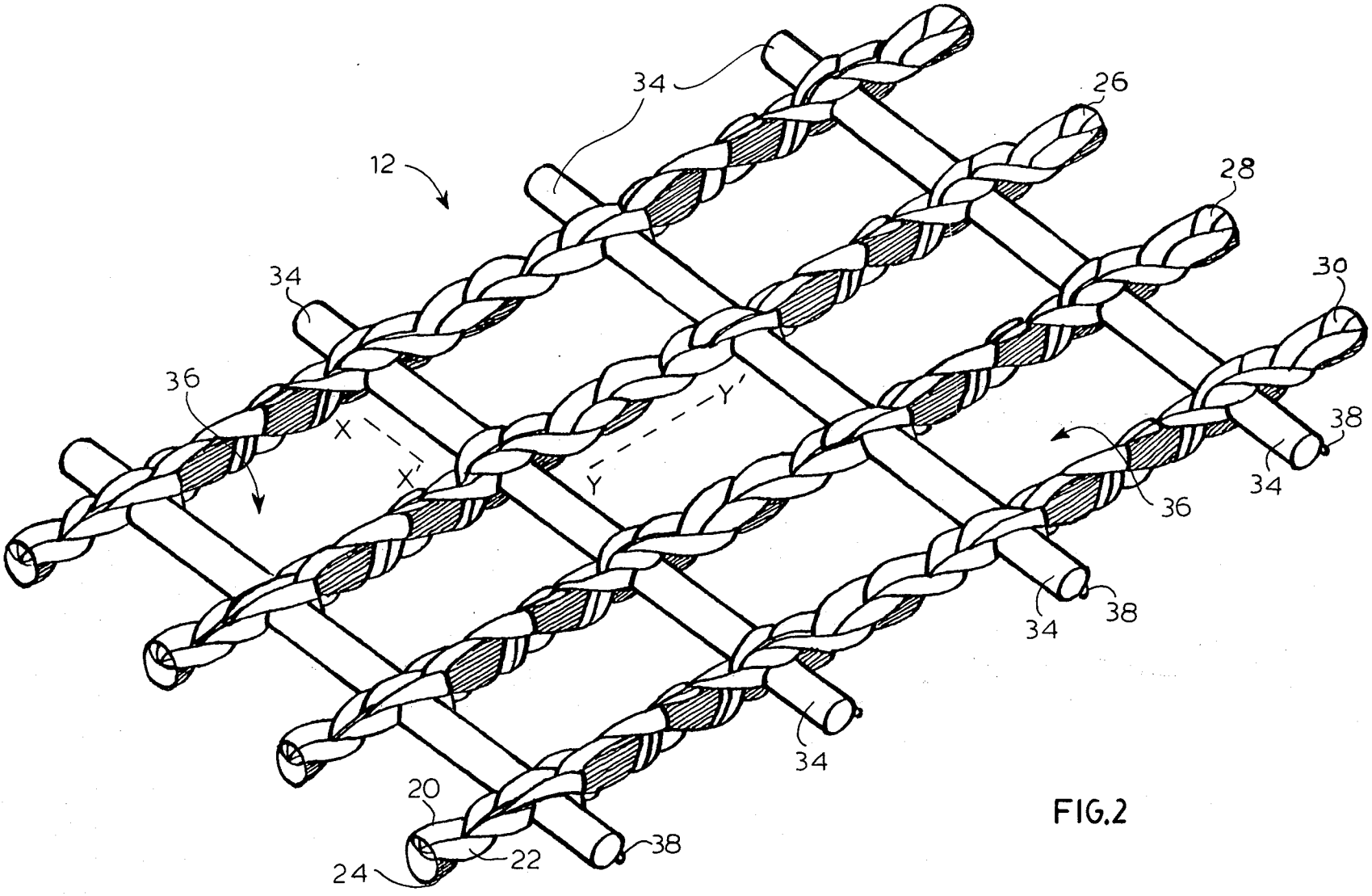
FIG. 2 is an enlarged view of the technical face of the fabric making up the conveyor belt of FIG. 1.

FIG. 2 is an enlarged view of the fabric 12 of the invention used in making the endless conveyor belt 10. As shown in FIG. 2, the open mesh fabric 12 is fabricated from three warpwise elements 20, 22, and 24 in each of an array of parallel chains 26, 28, 30 extending in the machine direction and evenly spaced from each other in any desired interval within the range of from between 2 to 12 per inch of fabric 12. The element 20 is the first chain stitch yarn, which may be a multifilament or spun yarn of synthetic or natural textile fibers. Preferably the chain stitch yarn 20 is a multifilament yarn. The preferred multifilament yarns 20 are multifilament polyamide yarns produced for example from nylons and the like. Particularly preferred for the higher temperature applications are yarns prepared from aromatic polyamides and most preferred are yarns prepared from fibers of the polyamide polymer of m-phenylenediamine and isophthaloyl chloride (commercially available under the trade name "Nomex" from E. I DuPont de Nemours and Co.) or from fibers of poly (p-phenylene terephthalamide) which are also commercially available under the trade name "Kevlar" from E. I. DuPont de Nemours and Co. The preference is based upon the high-temperature resistance of these fibers. The term "high temperature resistant" as used herein means an ability to withstand continued exposure to temperatures of from about 100° F. to at least about 350° F. Certain fabric embodiments of the invention will withstand temperatures of at least about 600° F. without substantial degradation and are preferred for applications where the higher temperature resistance is required.

In FIG. 2, the element 22 is the second chain stitch yarn such as the yarn 20, but forming an underlap shifting alternately to the right and left between each pair of adjacent chains, for example 26 to 28, 28 to 26, or 28 to 30, 30 to 28 and so on. The yarns 22, which alternate between adjacent chains and form the underlaps, aid in binding the structure together, and provide resistance to distortion by mechanically holding the warpwise elements in an evenly-spaced array, but they do not contribute materially to the fabric's strength properties. After resin treatment of the fabric, (as will be discussed more fully hereinafter) this stability is maintained by the binding properties of a resin coating so that it becomes immaterial if the underlaps should happen to fail in service, as from abrasion, for example.

In general, the yarns 20, 22 have a total denier in the range of from about 200 to about 1000 and preferably within the range of from about 300 to about 800.

The yarns 24 are the third warpwise element making up the machine-direction chains 26, 28, 30 and are reinforcing lay-in yarns.

The machine direction strength of the fabric 12 is established primarily by the lay-in yarns 24 which account for the major share of the total denier of the machine-direction elements. These lay-ins are comprised of low twist yarns, and they lie in the chains 26, 28, 30 in an essentially straight-line configuration, thus contributing to a high efficiency of strength translation.

The reinforcing lay-in yarns 24 may be multifilament yarns of high temperature resistant materials as described above for the yarns 20, 22. The deniers of the reinforcing lay-in yarns 24 may advantageously range from about 400 to about 5000.

Figure 3:
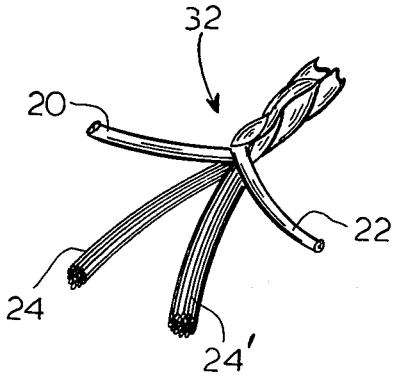
FIG. 3 is a view of an alternate embodiment of the reinforcing lay-in components of the fabric seen in FIG. 2.

In an alternate embodiment of the invention, two reinforcing lay-in yarns 24 may be employed instead of a single one as shown in FIG. 3, a view of a machine-direction chain 32 including a yarn 24 and a second identical yarn 24'. When two yarns 24, 24' are used as reinforcing lay-in yarns, they may each have a linear density which is about half of that required when a single yarn 24 is employed.

Figure 4:
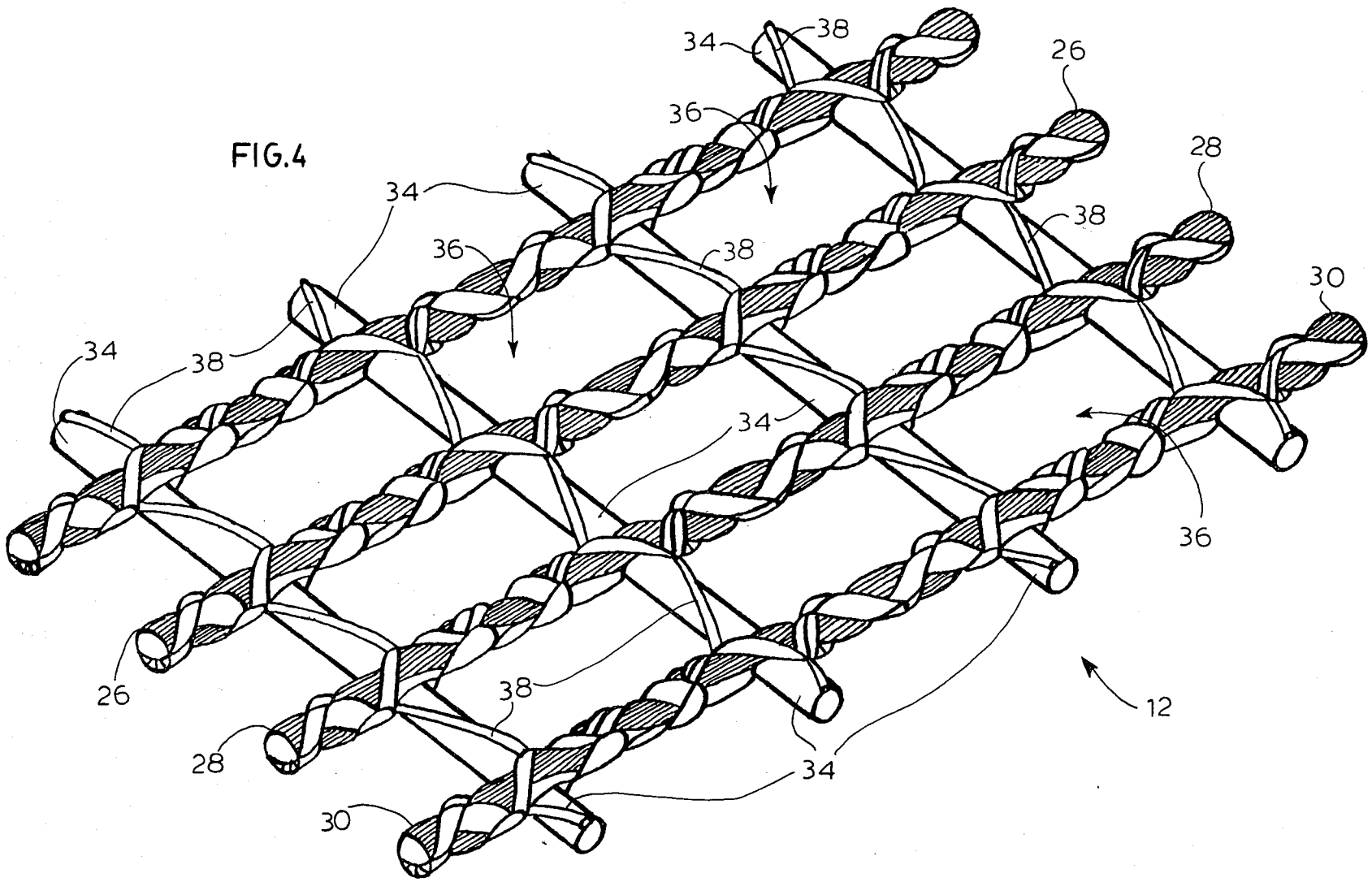
FIG. 4 is an enlarged view of the technical back of the fabric shown in FIG. 2.

Referring again to FIG. 2, it will be observed that the machine-direction chains 26, 28, 30 are supplemented by the periodic introduction of weft yarns 34 in the cross-machine direction, again according to any desired even spacing (preferably 2 to 12 per fabric inch), thus forming a mesh structure of uniform, rectangular openings 36 of any desired dimensions. Each of the inserted wefts 34 is bound into every chain; additionally, the yarns 22 shift from one chain to the adjacent chain simultaneously with the insertion of each weft yarn 34 such that they are superimposed upon, and almost completely hidden (when viewed from the technical face side of the fabric) by the weft yarns 34. This shifting goes to the right on one weft insertion, alternates to the left on the next insertion, and approaches another shift to the right just before insertion of the third weft yarn 34, thus completing one repeat of the pattern. This shifting of the yarn 22 to form underlaps 38 may be seen best in FIG. 4, a view of the obverse or technical back of the fabric 12 shown in FIG. 2.

The weft yarns 34 are preferably high modulus, high-tensile strength, high temperature-resistant yarns such as, for example, composite yarns of high-tensile strength core covered with a braid of high temperature resistant, synthetic polymeric resin filaments. Preferably, the composite yarns 34 are prepared by braiding a polyamide fiber multifilament yarn, such as one within the scope of those described above for the yarns 20, 22, over a core material. Preferred as the polyamide fiber in the weft 34 is the fiber obtained from the polyamide polymer of m-phenylenediamine and isophthalyol chloride.

The core materials used in the yarns 34 may be fiberglass, E glass and like fibers; metal wires such as Chromel R, Rene 41, Halstelloy B, phosphor bronze and the like; and combinations of the above. Preferred as the core material is a bundle of fiberglass (multifilament glass yarns) with a single strand of phosphorous bronze wire. The fabrication of such composite yarns is well known in the art and need not be discussed here. Other yarns meeting the above requirements are well known to those skilled in the art.

Following production of the fabric 12, it is advantageously treated by coating it with a heat-resistant, synthetic polymeric resin. The fabric 12 may be coated by any conventional means of coating fabrics with a resin such as by dipping, spraying or doping wwith a high temperature-resistant resin composition hereinafter described. The coating is applied so as to completely and evenly encapsulate the warp and weft yarns and their component filaments. This generally also may serve to provide additional heat and abrasion resistance to the fabric of the invention.

The amount of resin applied is generally not critical, however, the fabrics 12 advantageously are coated with resin such that the finished fabric weight of which from 2.5 to 50.0 percent comprises resin weight. The preferred fabrics have weights of which from 2.5 percent to 15 percent comprises resin weight.

The resin coating employed may be any high temperature resistant resin coating composition selected from solutions, mixtures or dispersions of a polyamide, polyimide, polyamide-imide resin mixtures thereof and the like.

More specific examples of the resin coating employed to make the coated fabric of the invention are, for example, the coating compositions of polyamide acids which upon curing yeild a polyimide coating or a polyamide-imide coating (see for example U.S. Pat. Nos. 3,179,633, 3,179,634; 3,518,219; 3,541,036; 3,546,152; 3,652,500 and 3,702,788 disclosing such polyamide and polyamide-imide forming coating compositions).

Polyamide coating compositions such as nylon coatings are generally well known.

Preferred resin coatings for preparing fabrics of the invention are the polyamide-imide polymers, more particularly described as polytrimellitamides, being prepared by the reaction of aromatic diamines with aryl halide derivatives of trimellitic anhydrides. The methods of their preparation are well known; see for example the methods of U.S. Pat. Nos. 3,049,518 and 3,260,691. Coating compositions of the preferred polytrimellitamide are generally well known and are commercially available (see for example the compositions of polytrimellitamide polymer enamel described in U.S. Pat. No. 3,451,848).

In addition to the high temperature resistant resin applied as a coating to the warp knitted fabric of the invention, other conventionally employed coating materials may be applied to the fabrics of the invention.

Figure 6:
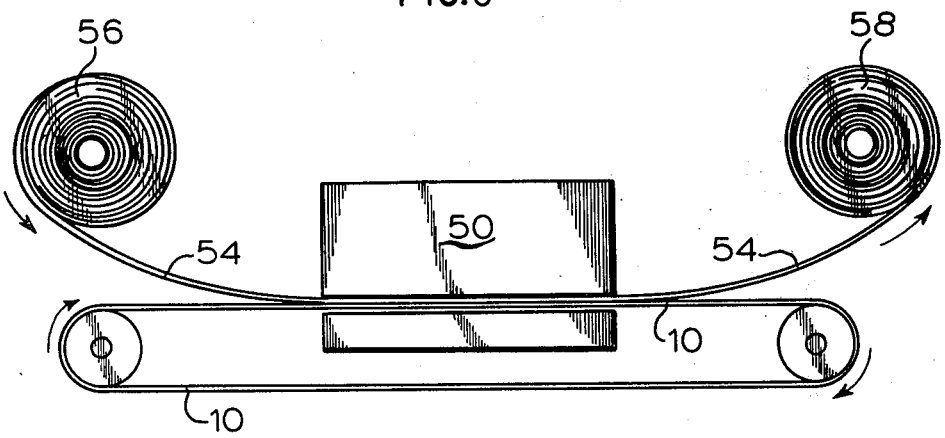
FIG. 6 is a schematic view of the belt of FIG. 1, mounted and conveying a textile through a drying oven.

FIG. 6 is a schematic diagram to show the improved method of the invention, whenever the belt 10 is used to convey a textile fabric 54 through a drying oven 50. The fabric 54 is delivered to the belt 10 from reel 56 and taken up after drying on reel 58. Direction of travel is indicated by arrows.

The following examples describe the manner and process of making and using the invention and set forth the best mode contemplated by the inventor of carrying out the invention, but are not to be construed as limiting.

EXAMPLE 1

A. Preparation of Knitted Fabric

A 2,800 denier (311.1 tex) continuous filament yarn, produced by plying two ends of 1,200 denier (133.3 tex) and two ends of 200 denier (22.2 tex) continuous filament yarns of a polymer of m-phenylenediamine and isophthaloyl chloride ("Nomex", E. I DuPont de Nemours and Co., Wilmington, Del.), and a 400 denier (44.4 tex) continuous filament yarn, produced by plying two ends of 200 denier (22.2 tex) continuous filament yarn of the same polymer obtained from the same source, are used as the warp on a Raschel warp knitting machine equipped with programmable weft-insertion.

The 400 denier (44.4 tex) yarn is used as the stitch yarn and threaded through the elements of guide bars 1 and 2 of the knitting machine; the 2,800 denier (311.1 tex) yarn is used as the lay-in yarn and threaded through the elements of guide bar 3. Each guide bar is threaded to achieve a density of 6 warp ends/inch (2.4 ends/cm).

A composite (sheath-core) yarn, consisting of a sheath of 4 ends of 1,200 denier (133.3 tex) continuous filament yarn, obtained from the same above mentioned source, braided over a core consisting of a bundle of 75/1 fiberglass yarn and a single strand of 0.008 inch (0.20 mm) diameter phosphorous bronze wire, is used as the weft.

Figure 5:
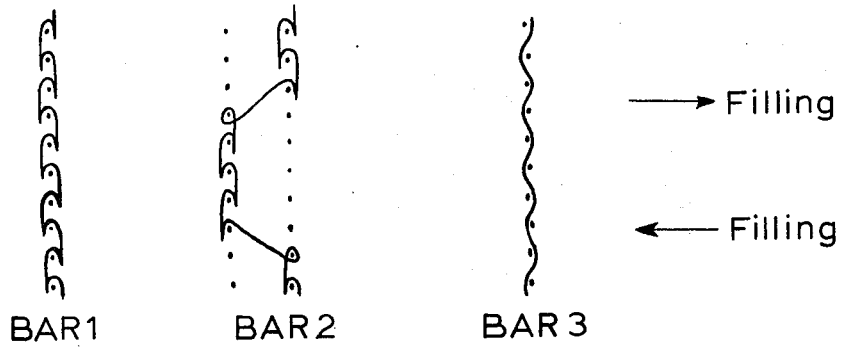
FIG. 5 gives the stitch diagrams and pattern chain sequences for the fabric of FIG. 2.

The guide bars and the weft-insertion mechanism of the knitting machine are programmed as shown in FIG. 5, to produce a knit fabric with approximately 4 wefts/inch (1.57 wefts/cm), weighing approximately 12 oz/sq yd (406.5 gm/m$^2$).

B. Coating of the Knit Fabric

A treating solution is made by diluting a 30 percent solution of the polytrimellitamide polymer obtained by reaction of p,p'-diaminodiphenylmethane with trimellitic anhydride acid chloride in N-methylpyrrolidone (AI 1030, Amoco Chemicals Co., Chicago, Ill.) with sufficient N-methylpyrrolidone to obtain a polymer concentration of about 10 percent by weight. The fabric of Part A, supra, is impregnated with the treating solution so as to increase the fabric weight by 10 percent, after drying and curing the resin impregnated fabric. After treatment with the resin solution, the wet fabric is dried for about 15 minutes at a temperature of 400° F. (210° C.) and then cured for about 15 minutes at a temperature of about 450° F. (230° C.) to 500° F. (260° C.).

The coated fabric obtained above was found to have a breaking strength of 285 lbs. per linear inch (499.3 N/cm), as determined by ASTM Method D1682). The fabric has a projected open area of approximately 70 percent.

EXAMPLE 2

Following the procedure of Example 1, supra, a fabric of the invention is prepared having a length of 133.3 ft. (40.6 m), a width of 94.5 inches (37.2 cm), a weight of 96 lbs. (43.5 kg), a breaking strength of 285 lbs./inch (499.3 N/cm) width (ASTM D-1682) and a projected open area of 70 percent. The fabric is joined at the ends of a fold-back pin seam to make an endless conveyor belt. The belt is easily installed in a conveyor oven to support knitted, or other types of fabrics, during drying. The belt operates at speeds of circa 90 yards/minute (82.2 m/min) and at temperatures of between 350°–400° F. (177°–204° C.). The belt tracks well, shows excellent dimensional stability and is highly resistant to abrasion. In particular, the belt shows excellent abrasion resistance on the edges, in contrast to open weave fiberglass belts coated with polytetrafluoroethylene, which abrade on the edges while being operated under the same conditions. The belt of this example also shows better dimensional stability, strength and tracking in comparison to the fiberglass belts coated with polytetrafluoroethylene. In comparison to a stainless steel wire belt, the belt of this example shows a better flex fatigue resistance and improved tracking characteristics.

Those skilled in the art will appreciate that many modifications may be made to the above-mentioned preferred embodiments without departing from the spirit and the scope of the invention. For example, the warp supply to the knitting machine may be combined such that only two guide bars are utilized to produce the knitted fabric, or the fabric may be knitted on machines that allow the insertion of lay-in warp yarns without utilizing guide bars.

What is claimed:

1. A fabric which comprises an open mesh of:

(a) at least three warpwise elements in each of an array of parallel warp knitted chains extending in the machine-direction, said chains being evenly spaced from each other in intervals of from 2 to 12 per inch of fabric, said elements comprising:
  (i) a first chain stitch yarn;
  (ii) a second chain stitch yarn with periodic underlaps connecting adjacent chains;
  (iii) a first reinforcing lay-in yarn having a linear density of from about 400 to about 1000 denier; and optionally
  (iv) a second reinforcing lay-in yarn having said linear density;
  provided that when the yarn (iv) is not present then the linear density of yarn (iii) is doubled; and (b) a plurality of cross machine-direction yarn components, evenly spaced from each other in intervals of from 2 to 12 per inch of fabric and positioned between the warpwise elements (i), (ii) and (iii).

2. The fabric of claim 1 wherein the yarns are high-temperature resistant yarns.

3. The fabric of claim 2 which is coated with a heat-resistant, synthetic polymeric resin.

4. An endless belt of the fabric of claim 1.

5. In a method of drying a textile fabric by supporting the fabric on a conveyor belting and conveying the supported fabric through a drying oven, the improvement which comprises: employing as the conveyor belt an endless fabric, which comprises: an open mesh of:

(a) at least three warpwwise elements in each of an array of parallel warp knitted chains extending in the machine-direction, said chains being evenly spaced from each other in intervals of from 2 to 12 per inch of fabric, said elements comprising:
  (i) a first chain-stitch yarn;
  (ii) a second chain-stitch yarn with periodic underlaps connecting adjacent chains;
  (iii) a first reinforcing lay-in yarn having a linear density of from about 400 to about 1000 denier; and optionally
  (iv) a second reinforcing lay-in yarn having said linear density; provided that when the yarn (iv) is not present then the linear density of yarn (iii) is doubled; and (b) a plurality of cross-machine direction yarn components evenly spaced from each other in intervals of from 2 to 12 per inch of fabric and positioned between the warpwise elements.

* * * * *